US008291934B2

(12) United States Patent
Gehlhoff et al.

(10) Patent No.: US 8,291,934 B2
(45) Date of Patent: Oct. 23, 2012

(54) PROPORTIONAL VALVE ASSEMBLY

(75) Inventors: Wade Leo Gehlhoff, Shakopee, MN (US); Chris William Schottler, Chanhassen, MN (US)

(73) Assignee: Eaton Corporation, Cleveland, OH (US)

( * ) Notice: Subject to any disclaimer, the term of this patent is extended or adjusted under 35 U.S.C. 154(b) by 374 days.

(21) Appl. No.: 12/690,724

(22) Filed: Jan. 20, 2010

(65) Prior Publication Data

US 2011/0174393 A1 Jul. 21, 2011

(51) Int. Cl.
*F15B 13/04* (2006.01)

(52) U.S. Cl. ..... 137/596.18; 137/596.15; 137/596.2

(58) Field of Classification Search ..... 137/596.1, 137/596.2, 596.18, 596.15
See application file for complete search history.

(56) References Cited

U.S. PATENT DOCUMENTS

| | | | | |
|---|---|---|---|---|
| 3,024,801 | A | 3/1962 | Carls | |
| 3,189,046 | A | 6/1965 | Callahan et al. | |
| 4,111,226 | A * | 9/1978 | Cameron | 137/269 |
| 4,340,086 | A | 7/1982 | Hemm et al. | |
| 4,478,245 | A | 10/1984 | Bender | |
| 4,585,206 | A | 4/1986 | Itoh | |
| RE32,644 | E | 4/1988 | Brundage et al. | |
| 4,813,447 | A | 3/1989 | Ichiryu et al. | |
| 4,848,721 | A | 7/1989 | Chudakov | |
| 4,905,959 | A | 3/1990 | Andersson | |
| 5,137,254 | A | 8/1992 | Aardema et al. | |
| 5,170,692 | A | 12/1992 | Lonnemo | |
| 5,207,059 | A | 5/1993 | Schexnayder | |
| 5,331,883 | A | 7/1994 | Andersson | |
| 5,421,545 | A | 6/1995 | Schexnayder | |
| 5,645,263 | A | 7/1997 | Aardema | |
| 6,038,957 | A | 3/2000 | Ertmann et al. | |
| 6,047,944 | A | 4/2000 | Hajek, Jr. | |
| 6,073,444 | A | 6/2000 | Horton et al. | |
| 6,089,528 | A | 7/2000 | Hajek, Jr. et al. | |
| 6,131,606 | A | 10/2000 | O'Neill | |
| 6,206,044 | B1 | 3/2001 | Gluf, Jr. | |

(Continued)

FOREIGN PATENT DOCUMENTS

DE 197 28 092 A1 1/1999

(Continued)

OTHER PUBLICATIONS

International Search Report and Written Opinion mailed Jul. 1, 2011.

(Continued)

*Primary Examiner* — Craig Schneider
(74) *Attorney, Agent, or Firm* — Merchant & Gould P.C.

(57) ABSTRACT

A valve assembly includes a valve housing defining a service passage, a first bore in fluid communication with the service passage, a first passage, a second bore in communication with the service passage and a second passage. The first bore has an inlet portion, a first service portion in communication with the service passage, and a first load holding portion. The first passage is in communication with the first load holding portion and the service passage. The second bore has a return portion, a second service portion in fluid communication with the first service passage, and a second load holding portion. The second passage is in selective communication with the second load holding portion of the second bore and the return passage. A valve is disposed in the second passage. The valve allows fluid to flow only in a direction from the second load holding portion to the return passage.

20 Claims, 6 Drawing Sheets

U.S. PATENT DOCUMENTS

| | | | | |
|---|---|---|---|---|
| 6,557,822 | B1 | 5/2003 | Yoshino | |
| 6,712,091 | B2 * | 3/2004 | Linser | 137/596.15 |
| 7,028,708 | B1 | 4/2006 | Langenfeld et al. | |
| 7,044,431 | B2 * | 5/2006 | Stumpe | 251/30.01 |
| 7,258,134 | B1 | 8/2007 | Langenfeld et al. | |
| 7,490,625 | B1 * | 2/2009 | Johnson et al. | 137/596.16 |
| 2005/0242310 | A1 | 11/2005 | Takiguchi et al. | |
| 2009/0050222 | A1 | 2/2009 | Jackson et al. | |

FOREIGN PATENT DOCUMENTS

| | | |
|---|---|---|
| JP | 60-196476 | 10/1985 |

OTHER PUBLICATIONS

EPV16 Series Valvistor Proportional Flow Controls, Eaton Corporation, Oct. 1999, 16 pages.

* cited by examiner

PROPORTIONAL VALVE ASSEMBLY

BACKGROUND

Valve assemblies are used in various applications including off-highway agriculture and construction equipment (e.g., wheel loaders, skid steers, combines, etc.). In some applications, valve assemblies are used to control the amount of fluid provided to implements such as buckets or booms. It is desired to have a valve assembly that is capable of some degree of load holding such that the implements can hold a load (e.g., extended boom, load in a bucket, etc.) for an extended period of time. In addition, it is desired to have a valve assembly that includes an anti-cavitation feature.

SUMMARY

An aspect of the present disclosure relates to a valve assembly. The valve assembly includes a valve housing. The valve housing defines a first service passage, a first valve bore, a first fluid passage, a second valve bore and a second fluid passage. The first valve bore is in fluid communication with the first service passage. The first valve bore has an inlet portion in fluid communication with an inlet passage of the valve housing, a first service portion in fluid communication with the first service passage, and a first load holding portion. The first valve bore has a first valve seat that is disposed between the inlet portion and the service portion. The first fluid passage is in selective fluid communication with the first load holding portion of the first valve bore and the first service passage. The second valve bore is in fluid communication with the first service passage. The second valve bore has a return portion in fluid communication with a return passage of the valve housing, a second service portion in fluid communication with the first service passage, and a second load holding portion. The second valve bore has a second valve seat that is disposed between the return passage and the first service passage. The second fluid passage is in selective communication with the second load holding portion of the second valve bore and the return passage. An inlet valve is disposed in the first valve bore. The inlet valve is moveable between a seated position and an unseated position. A return valve assembly is disposed in the second valve bore. The return valve is moveable between a seated position and an unseated position. A one-way valve is disposed in the second fluid passage. The one-way valve allows fluid to flow only in a direction from the second load holding portion to the return passage.

Another aspect of the present disclosure relates to a valve assembly. The valve assembly includes a valve housing. The valve housing defines a first service passage, a first valve bore, a first fluid passage, a second valve bore and a second fluid passage. The first valve bore is in fluid communication with the first service passage. The first valve bore has an inlet portion in fluid communication with an inlet passage of the valve housing, a first service portion in fluid communication with the first service passage, and a first load holding portion. The first valve bore has a first valve seat that is disposed between the inlet portion and the service portion. The first fluid passage is in selective fluid communication with the first load holding portion of the first valve bore and the first service passage. The second valve bore is in fluid communication with the first service passage. The second valve bore has a return portion in fluid communication with a return passage of the valve housing, a second service portion in fluid communication with the first service passage, and a second load holding portion. The second valve bore has a second valve seat that is disposed between the return passage and the first service passage. The second fluid passage is in selective communication with the second load holding portion of the second valve bore and the return passage. An inlet valve is disposed in the first valve bore. The inlet valve includes a body defining a first metering passage through the body. The first metering passage is in fluid communication with the inlet passage and the first load holding portion of the first valve bore. The inlet valve further includes a check valve disposed in the first metering passage. The check valve provides fluid flow only in a direction from the inlet passage to the first load holding cavity. A return valve assembly is disposed in the second valve bore. The return valve defines a second metering passage that provides fluid communication between the second load holding portion and the second service portion of the second valve bore. A one-way valve is disposed in the second fluid passage. The one-way valve allows fluid to flow only in a direction from the second load holding portion to the return passage.

Another aspect of the present disclosure relates to a valve assembly. The valve assembly includes a pilot stage valve assembly, a middle stage valve assembly that is in fluid communication with the pilot stage valve assembly and a main stage valve assembly. The main stage valve assembly is in fluid communication with the middle stage valve assembly. The main stage valve assembly includes a valve housing. The valve housing defines a first service passage, a first valve bore, a first fluid passage, a second valve bore and a second fluid passage. The first valve bore is in fluid communication with the first service passage. The first valve bore has an inlet portion in fluid communication with an inlet passage of the valve housing, a first service portion in fluid communication with the first service passage, and a first load holding portion. The first valve bore has a first valve seat that is disposed between the inlet portion and the service portion. The first fluid passage is in selective fluid communication with the first load holding portion of the first valve bore and the first service passage. The second valve bore is in fluid communication with the first service passage. The second valve bore has a return portion in fluid communication with a return passage of the valve housing, a second service portion in fluid communication with the first service passage, and a second load holding portion. The second valve bore has a second valve seat that is disposed between the return passage and the first service passage. The second fluid passage is in selective communication with the second load holding portion of the second valve bore and the return passage. An inlet valve is disposed in the first valve bore. The inlet valve includes a body defining a first metering passage through the body. The first metering passage is in fluid communication with the inlet passage and the first load holding portion of the first valve bore. The inlet valve further includes a check valve disposed in the first metering passage. The check valve provides fluid flow only in a direction from the inlet passage to the first load holding cavity. A return valve assembly is disposed in the second valve bore. The return valve defines a second metering passage that provides fluid communication between the second load holding portion and the second service portion of the second valve bore. A one-way valve is disposed in the second fluid passage. The one-way valve allows fluid to flow only in a direction from the second load holding portion to the return passage.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
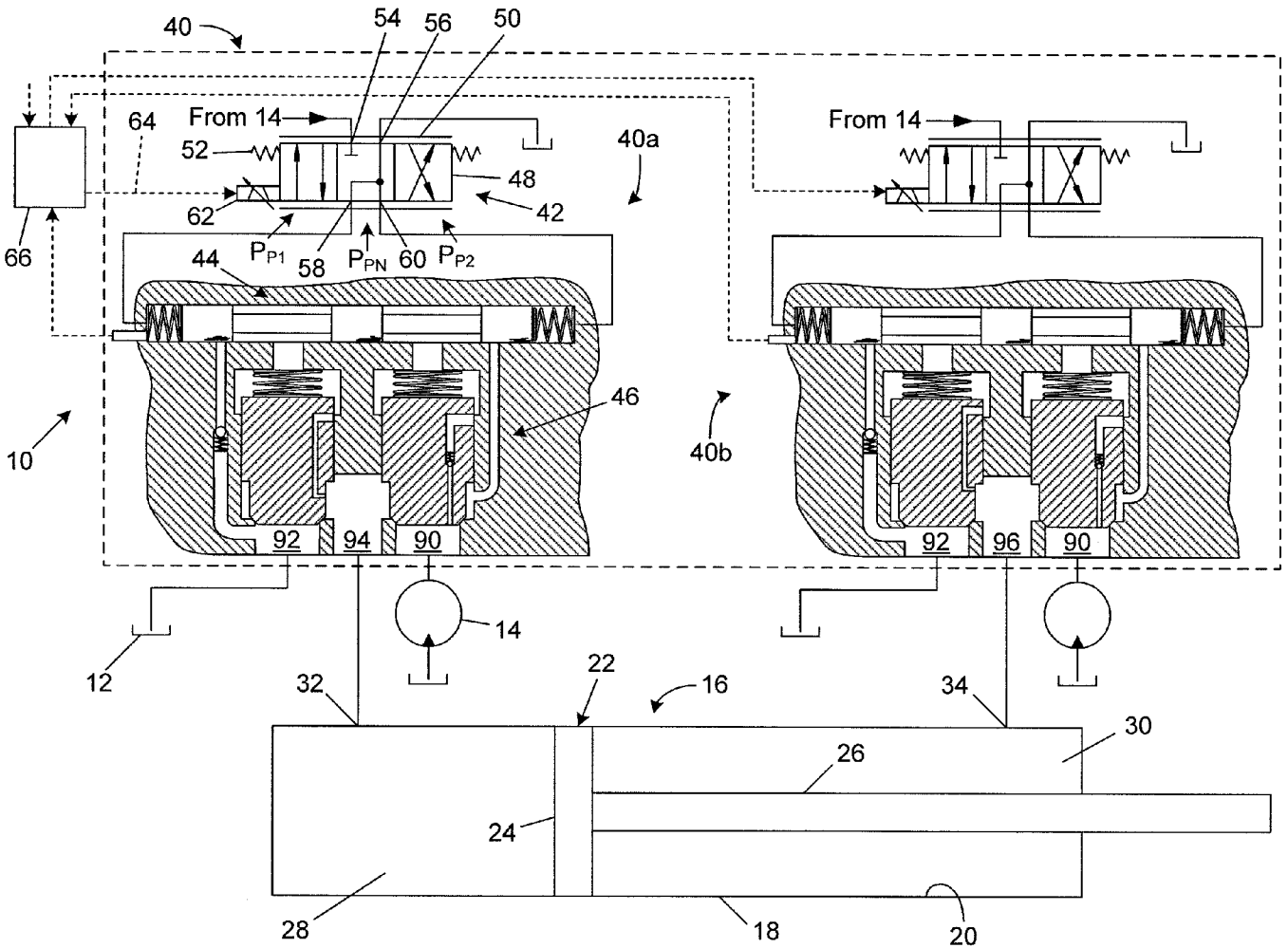
FIG. 1 is a schematic representation of a fluid system having exemplary features of aspects in accordance with the principles of the present disclosure.

Referring now to FIG. 1, a fluid system, generally designated 10, is shown. The fluid system 10 includes a fluid reservoir 12, a fluid pump 14, and a fluid actuator 16. While the fluid actuator 16 is shown in FIG. 1 as being a linear actuator (e.g., a cylinder, etc.), it will be understood that the actuator 16 could alternatively be a rotary actuator (e.g., a fluid motor, etc.).

The fluid actuator 16 includes a housing 18 defining a bore 20. A piston assembly 22 is disposed in the bore 20. The piston assembly 22 includes a piston 24 and a rod 26. The piston 24 of the piston assembly 22 separates the bore 20 into a first chamber 28 and a second chamber 30. In the depicted embodiment, the fluid actuator 16 is a double acting cylinder. The rod 26 of the piston assembly 22 extends from the housing 18 of the fluid actuator 16 when fluid from the fluid pump 14 is directed to the first chamber 28 and fluid in the second chamber 30 is vented to the fluid reservoir 12. The rod 26 retracts when fluid from the fluid pump 14 is directed to the second chamber 30 and fluid in the first chamber 28 is vented to the fluid reservoir 12.

The fluid actuator 16 further includes a first port 32 and a second port 34. The first port 32 is in fluid communication with the first chamber 28 while the second port 34 is in fluid communication with the second chamber 30.

The fluid system 10 further includes a valve assembly 40, is shown. In the depicted embodiment, the valve assembly 40 includes a first valve assembly 40*a* and a second valve assembly 40*b*. The first valve assembly 40*a* selectively provides fluid communication between the fluid pump 14 and/or fluid reservoir 12 and the first chamber 28 of the fluid actuator 16 while the second valve assembly 40*b* selectively provides fluid communication between the fluid pump 14 and/or the fluid reservoir 12 and the second chamber 30 of the fluid actuator 16. As the first and second valve assemblies 40*a*, 40*b* are substantially similar in structure, only the first valve assembly 40*a* will be described for ease of description purposes.

In the depicted embodiment, each of the first and second valve assemblies 40*a*, 40*b* includes three stages: a pilot stage valve assembly 42, a middle stage valve assembly 44 and a main stage valve assembly 46.

The pilot stage valve assembly 42 is a proportional valve that includes a pilot stage spool valve 48 and a housing 50. The pilot stage spool valve 48 is disposed in a bore of the housing 50 such that the pilot stage spool valve 48 is axially slidable in the bore of the housing 50.

The pilot stage valve assembly 42 further includes a plurality of centering springs 52. The plurality of centering springs 52 is adapted to center the pilot stage spool valve 48 in the bore of the housing 50.

In the depicted embodiment, the pilot stage valve assembly 42 is a four-way valve. The pilot stage valve assembly 42 includes a fluid inlet port 54, a fluid return port 56, a first control port 58 and a second control port 60. In the depicted embodiment, the pilot stage valve assembly 42 is a three-position valve. The pilot stage valve assembly 42 includes a neutral position $P_{PN}$, a first position $P_{P1}$ and a second position $P_{P2}$.

In the neutral position $P_{PN}$, the first and second control ports 58, 60 are in fluid communication with the fluid return port 56. In the first position $P_{P1}$, the first control port 58 is in fluid communication with the fluid inlet port 54 while the second control port 60 is in fluid communication with the fluid return port 56. In the second position $P_{P2}$, the first control port 58 is in fluid communication with the fluid return port 56 while the second control port 60 is in fluid communication with the fluid inlet port 54.

As a proportional valve, the axial position of the pilot stage spool valve 48 in the bore of the housing 50 controls the amount of fluid that passes through the pilot stage valve assembly 42. The pilot stage valve assembly 42 includes an electronic actuator 62 that is adapted to axially move the pilot stage spool valve 48 in the bore of the housing 50 between the neutral position $P_{PN}$ and the first and second positions $P_{P1}$, $P_{P2}$. In one aspect of the present disclosure, the electronic actuator 62 is a voice coil.

The electronic actuator 62 is actuated in response to an electronic signal 64 (shown as a dashed lined in FIG. 1) received from a microprocessor 66. In one aspect of the present disclosure, the microprocessor 66 provides the electronic signal 64 in response to various input signals.

Figure 2:
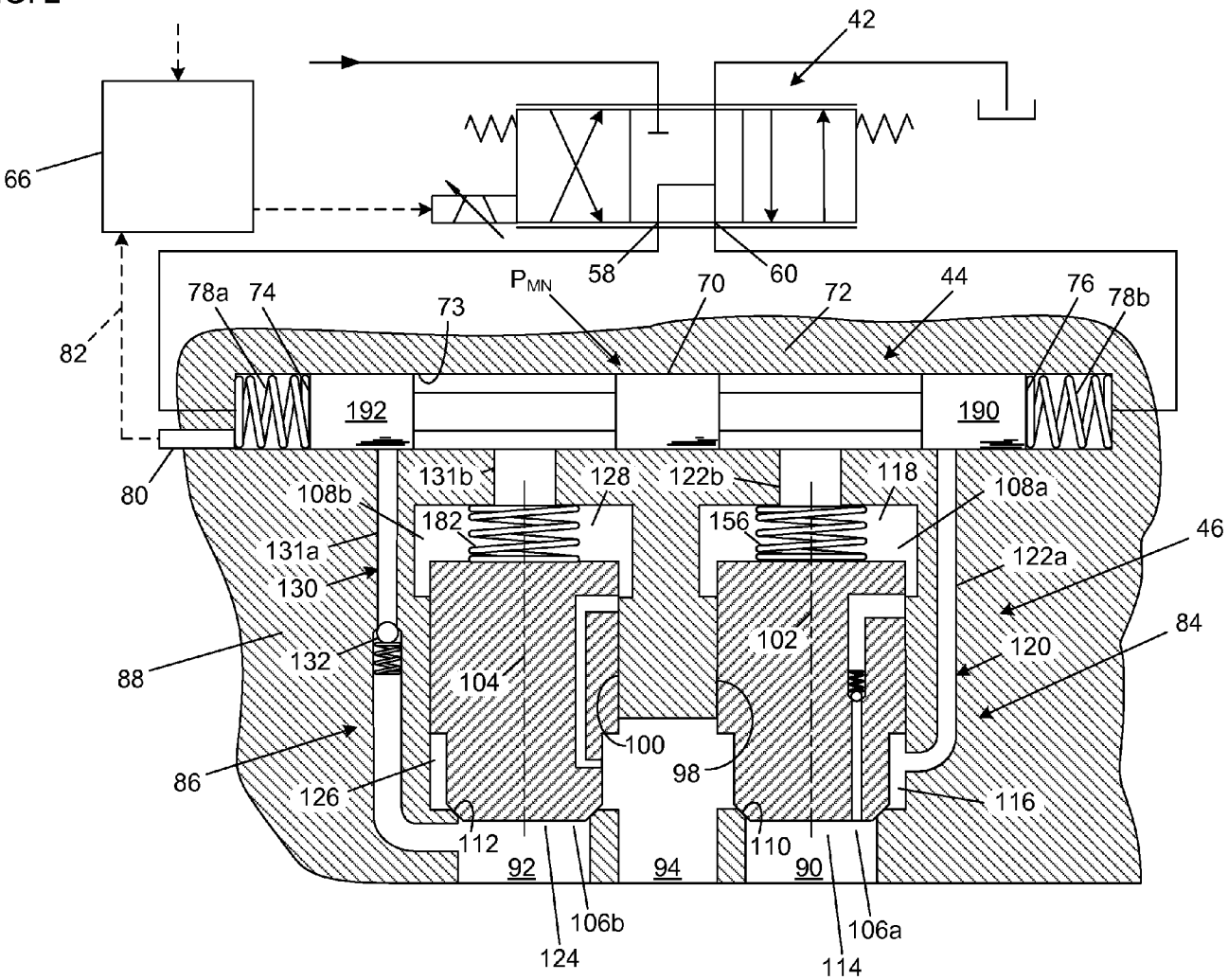
FIG. 2 is a schematic representation of a valve assembly suitable for use with the fluid system of FIG. 1.

Referring now to FIGS. 1 and 2, the first and second control ports 58, 60 of the pilot stage valve assembly 42 are in fluid communication with the middle stage valve assembly 44. In one aspect of the present disclosure, the middle stage valve assembly 44 is a three-position, four-way proportional valve. In another aspect of the present disclosure, the middle stage valve assembly 44 is a two-position, two-way proportional valve.

The middle stage valve assembly 44 includes a middle stage spool valve 70 disposed in a housing 72. The middle stage spool valve 70 is disposed in a bore 73 of the housing 72 such that the middle stage spool valve 70 is axially slidable in the bore 73 of the housing 72.

The middle stage spool valve 70 includes a first axial end 74 and an oppositely disposed second axial end 76. A first spring 78*a* acts on the first axial end 74 of the middle stage spool valve 70 while a second spring 78*b* acts on the second axial end 76. The first and second springs 78*a*, 78*b* are adapted to center the middle stage spool valve 70 in the bore 73 of the housing 72.

The axial position of the middle stage spool valve 70 in the bore 73 of the housing is controlled by fluid pressure acting on one of the first and second axial ends 74, 76. In one aspect of the present disclosure, the first control port 58 of the pilot stage valve assembly 42 is in fluid communication with the first axial end 74 of the middle stage spool valve 70 while the second control port 60 of the pilot stage valve assembly 42 is in fluid communication with the second axial end 76.

The middle stage valve assembly 44 further includes a position sensor 80. In one aspect of the present disclosure, the position sensor 80 is a linear variable displacement transducer (LVDT). The position sensor 80 senses the position of the middle stage spool valve 70 in the bore 73 of the housing 72. The position sensor 80 sends a signal 82 to the microprocessor 66, which uses the positional data from the position sensor 80 to actuate the electronic actuator 62 of the pilot stage valve assembly 42. The positions of the middle stage valve assembly 44 will be described in greater detail subsequently.

The middle stage valve assembly 44 is in fluid communication with the main stage valve assembly 46. Each of the main stage valve assemblies 46 of the first and second valve assemblies 40*a*, 40*b* includes an inlet valve 84 and a return valve 86. In the depicted embodiment, the inlet valve 84 is in fluid communication with the fluid pump 14 while the return valve 86 is in fluid communication with the fluid reservoir 12.

Each of the main stage valve assemblies 46 of the first and second valve assemblies 40*a*, 40*b* is disposed in the valve housing 88. In the depicted embodiment, the valve housing 88 is the same structure as the housing 72 of the middle stage valve assembly 44. In another embodiment, the valve housing 88 is a different structure from the housing 72 of the middle stage valve assembly 44.

The valve housing 88 defines a plurality of fluid passages. In the depicted embodiment, the valve housing 88 defines an inlet passage 90, a return passage 92, a first service passage 94 and a second service passage 96. The inlet passage 90 is in fluid communication with the fluid pump 14 while the return passage 92 is in fluid communication with the fluid reservoir 12. The first and second service passages 94, 96 are in fluid communication with the fluid actuator 16. In the depicted embodiment, the first service passage 94 is in fluid communication with the first port 32 of the fluid actuator 16 while the second service passage 96 is in fluid communication with the second port 34 of the fluid actuator 16. In the depicted embodiment, the main stage valve assembly 46 of the first valve assembly 40*a* provides selective fluid communication between the fluid pump 14 and/or the fluid reservoir 12 and the first service passage 94 while the main stage valve assembly 46 of the second valve assembly 40*b* provides selective fluid communication between the fluid pump 14 and/or the fluid reservoir 12 and the second service passage 96.

As previously provided, the first and second valve assemblies 40*a*, 40*b* are substantially similar in the depicted embodiment. As the first and second valve assemblies 40*a*, 40*b* are substantially similar, only the features of the valve housing 88 that are associated with the first valve assembly 40*a* will be described for ease of description purposes. It will be understood that the valve housing 88 includes similar features associate with the second valve assembly 40*b*.

Referring now to FIG. 2, the valve housing 88 defines a first valve bore 98 and a second valve bore 100. The first valve bore 98 includes a first longitudinal axis 102 and is adapted to receive the inlet valve 84 of the first valve assembly 40*a* while the second valve bore 100 includes a second longitudinal axis 104 and is adapted to receive the return valve 86 of the first valve assembly 40*a*.

Each of the first and second valve bores 98, 100 includes a first axial end 106*a*, 106*b* and an oppositely disposed second axial end 108*a*, 108*b*. The first axial end 106*a* of the first valve bore 98 includes a first valve seat 110 while the first axial end 106*b* of the second valve bore 100 includes a second valve seat 112. The first and second valve seats 110, 112 are adapted for selective sealing engagement with the inlet and return valves 84, 86, respectively. Each of the first and second valve seats 110, 112 of the first and second valve bores 98, 100 is tapered so that each of the first and second valve seats 110, 112 includes an inner diameter that decreases as the distance along the first and second longitudinal axes 102, 104 from the first and second valve seats 110, 112 to the second axial ends 108*a*, 108*b* increases. In the depicted embodiment, the first and second valve seats 110, 112 are generally frusto-conical in shape.

The first valve bore 98 includes an inlet portion 114, a first service portion 116 and a first load holding portion 118. The inlet portion 114 is disposed at the first axial end 106*a* of the first valve bore 98 and is in fluid communication with the inlet passage 90. The first service portion 116 is disposed between the first and second axial ends 106*a*, 108*a* of the first valve bore 98 and is in fluid communication with the first service passage 94. The first load holding portion 118 is disposed at the second axial end 108*a* of the first valve bore 98.

The valve housing 88 defines a first fluid passage 120 that is in fluid communication with the first load holding portion 118 of the first valve bore 98 and the first service portion 116 of the first valve bore 98. The first fluid passage 120 includes a first portion 122*a* that is in fluid communication with the first service portion 116 of the first valve bore 98 and the bore 73 of the middle stage valve assembly 44 and a second portion 122*b* that is in fluid communication with the first load holding portion 118 of the first valve bore 98 and the bore 73 of the middle stage valve assembly 44. Actuation of the middle stage spool valve 70 opens or blocks fluid communication between the first and second portions 122*a*, 122*b* of the first fluid passage 120.

The second valve bore 100 includes a return portion 124, a second service portion 126 and a second load holding portion 128. The return portion 124 is disposed at the first axial end 106*b* of the second valve bore 100 and is in fluid communication with the return passage 92. The second service portion 126 is disposed between the first and second axial ends 106*b*, 108*b* of the second valve bore 100 and is in fluid communication with the first service passage 94. The second load holding portion 128 is disposed at the second axial end 108*b* of the second valve bore 100.

The valve housing 88 defines a second fluid passage 130 that is in fluid communication with the return portion 124 of the second valve bore 100 and the second load holding portion 128 of the second valve bore 100. The second fluid passage 130 includes a first portion 131*a* that is in fluid communication with the return portion 124 of the second valve bore 100 and the bore 73 of the middle stage valve assembly 44 and a second portion 131*b* that is in fluid communication with the second load holding portion 128 of the second valve bore 100 and the bore 73 of the middle stage valve assembly 44. Actuation of the middle stage spool valve 70 opens or blocks fluid communication between the first and second portions 131*a*, 131*b* of the second fluid passage 130.

The second fluid passage 130 includes a one-way valve 132 disposed in the second fluid passage 130. In the depicted embodiment, the one-way valve 132 is a check ball. The one-way valve 132 allows fluid to flow in a direction from the second load holding portion 128 of the second valve bore 100 to the return passage 92 but prevents fluid from flowing in a direction from the return passage 92 to the second loading holding portion 128 of the second valve bore 100. As will be described in greater detail subsequently, the one-way valve 132 disposed in the second fluid passage 130 enables the return valve 86 to function as an anti-cavitation valve. Cavitation in the fluid system 10 occurs when the fluid actuator 16 requires more fluid than is being provided by the fluid pump 14. As will be described in greater detail subsequently, the one-way valve 132 enables the return valve 86 to provide fluid communication between the return passage 92 and the first service passage 94 so that fluid from the fluid reservoir 12 is communicated to the fluid actuator 16.

Figure 3:
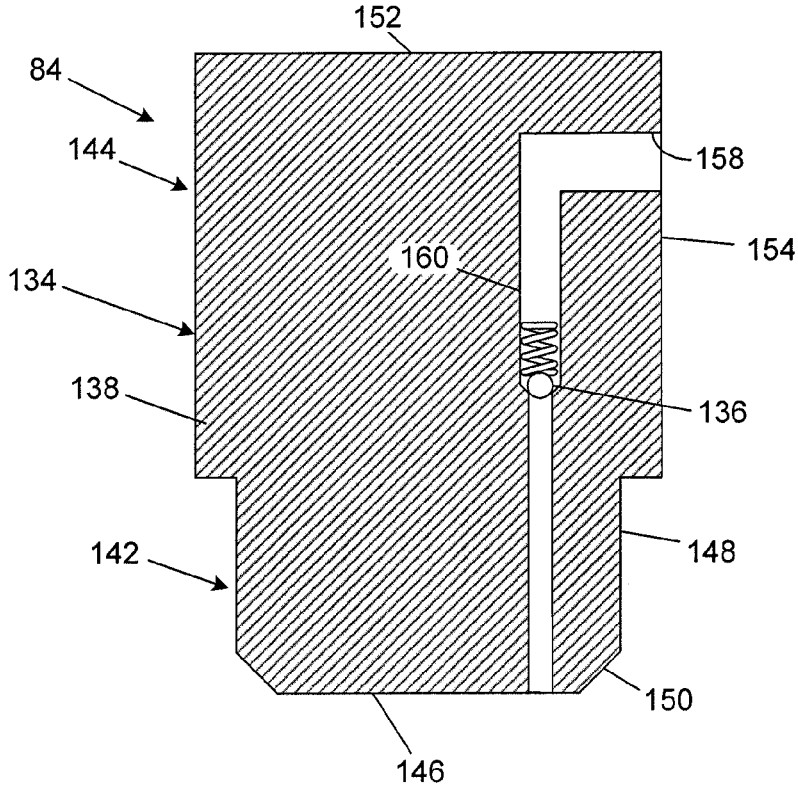
FIG. 3 is a schematic representation of an inlet valve assembly suitable for use in the valve assembly of FIG. 2.

Referring now to FIGS. 2 and 3, the inlet valve 84 will be described. A poppet valve assembly that is suitable for use as the inlet valve 84 of the main stage valve assembly 46 has been described in U.S. patent application Ser. No. 12/536,190, the disclosure of which is hereby incorporated by reference in its entirety. The inlet valve 84 includes a first poppet valve 134 and a check valve 136 disposed in the first poppet valve 134.

The first poppet valve 134 includes a body 138 having a first axial end portion 142 and an oppositely disposed second axial end portion 144. The first axial end portion 142 includes a first end surface 146 and a first circumferential surface 148. The first circumferential surface 148 is generally cylindrical in shape. In one aspect of the present disclosure, the first circumferential surface 148 includes a first tapered surface. The first tapered surface is adapted for selective sealing engagement with the first valve seat 110 of the first valve bore 98. The first tapered surface is disposed adjacent to the first end surface 146. The first tapered surface is generally frusto-conical in shape.

The second axial end portion 144 includes a second end surface 152 and a second circumferential surface 154. The second end surface 152 is oppositely disposed from the first end surface 146. The second end surface 152 is adapted to abut a first spring 156 disposed in the first load holding portion 118 of the first valve bore 98. The first spring 156 is adapted to bias the inlet valve 84 so that first tapered surface abuts the first valve seat 110.

The second circumferential surface 154 is generally cylindrical in shape. The second circumferential surface 154 defines a first metering slot 158 that extends into the body 138 in a radial direction.

The body 138 defines a first metering passage 160 that extends in an axial direction from the first end surface 146 to the first metering slot 158. The first metering passage 160 is adapted to provide fluid communication between the inlet passage 90 and the first load holding portion 118 of the first valve bore 98. The flow through the first metering passage 160 and the flow through the first fluid passage 120 of the valve housing 88 cooperatively determine the axial position of the inlet valve 84 in the first valve bore 98 and the amount of fluid that can pass from the inlet passage 90 to the first service passage 94 at a given pressure.

The check valve 136 is disposed in the first metering passage 160. The check valve 136 provides one-way fluid communication through the first metering passage 160 in a direction from inlet passage 90 to the first load holding portion 118 of the first valve bore 98. The check valve 136 prevents fluid from being communicated in a direction from the first load holding portion 118 of the first valve bore 98 to the inlet passage 90. The check valve 136 is adapted to prevent leakage through the first metering passage 160. Leakage flowing in the direction from the first load holding portion 118 of the first valve bore 98 to the inlet passage 90 can result in the inlet valve 84 being inadvertently unseated from the first valve seat 110.

Figure 4:
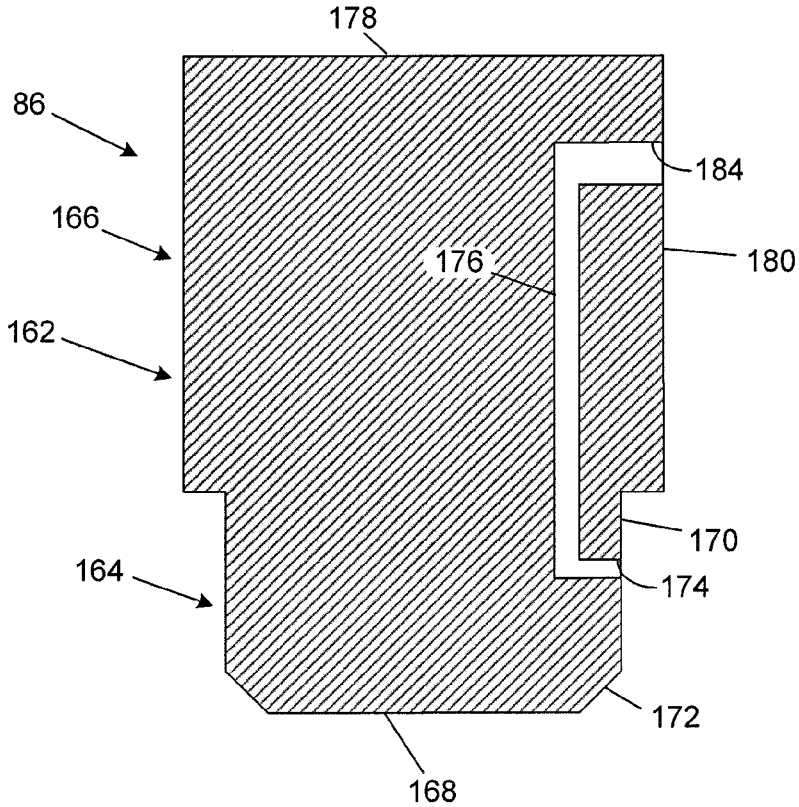
FIG. 4 is a schematic representation of a return valve assembly suitable for use in the valve assembly of FIG. 2.

Referring now to FIGS. 2 and 4, the return valve 86 will be described. The return valve 86 includes a second poppet valve 162. The second poppet valve 162 includes a first end portion 164 and an oppositely disposed second end portion 166.

The first end portion 164 includes a first end face 168 and a first circumferential surface 170. The first circumferential surface 170 is generally cylindrical in shape. In one aspect of the present disclosure, the first circumferential surface 170 includes a second tapered surface 172. The second tapered surface 172 is adapted for selective sealing engagement with the second valve seat 112 of the second valve bore 100. The second tapered surface 172 is disposed adjacent to the first end face 168. In the depicted embodiment, the second tapered surface 172 is generally frusto-conical in shape.

The first circumferential surface 170 defines a first orifice 174. The first orifice 174 is in fluid communication with a second metering passage 176 defined by the second poppet valve 162.

The second end portion 166 includes a second end face 178 and a second circumferential surface 180. The second end face 178 is oppositely disposed from the first end face 168. The second end face 178 is adapted to abut a second spring 182 disposed in the second load holding portion 128 of the second valve bore 100. The second spring 182 is adapted to bias the return valve 86 so that second tapered surface 172 abuts the second valve seat 112.

The second circumferential surface 180 is generally cylindrical in shape. The second circumferential surface 180 defines a second metering slot 184 that extends into the second poppet valve 162 in a radial direction. The second metering slot 184 is in fluid communication with the second metering passage 176.

The second metering passage 176 provides fluid communication between the second service portion 126 of the second valve bore 100 and the second load holding portion 128 of the second valve bore 100. The flow through the second metering passage 176 and the flow through the second fluid passage 130 of the valve housing 88 cooperatively determine the axial position of the return valve 86 in the second valve bore 100 and the amount of fluid that can pass from the first service passage 94 to the return passage 92 at a given pressure.

Figure 5:
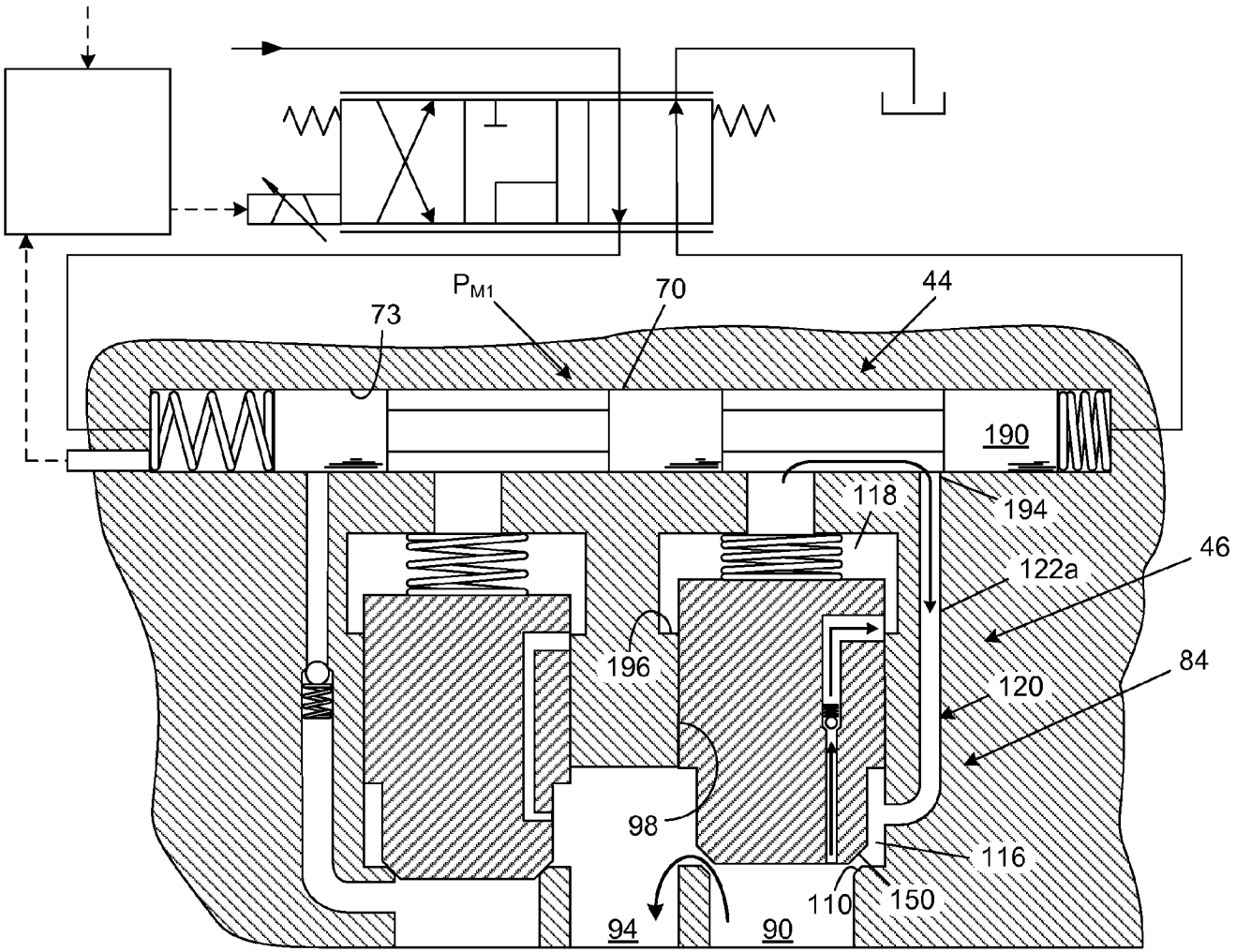
FIG. 5 is a schematic representation of the valve assembly with a middle stage valve assembly in a first position and the inlet valve assembly in an unseated position.
Figure 6:
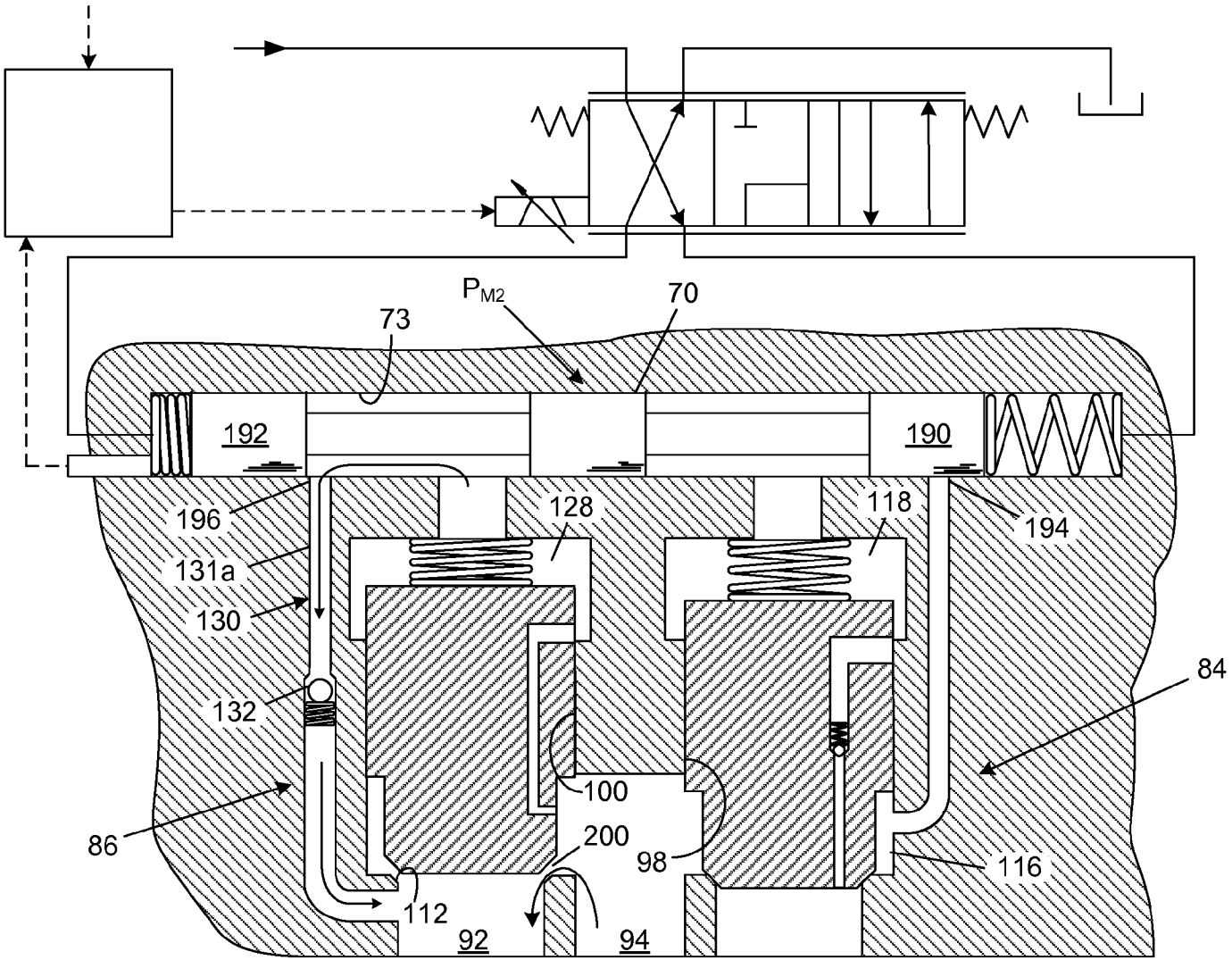
FIG. 6 is a schematic representation of the valve assembly with the middle stage valve assembly in a second position and the return valve assembly in an unseated position.

Referring now to FIGS. 2, 5 and 6, the actuation positions of the middle stage valve assembly 44 will be described. The middle stage valve assembly 44 includes a neutral position $P_{MN}$ (shown in FIG. 2), a first position $P_{M1}$ (shown in FIG. 5), and a second position $P_{M2}$ (shown in FIG. 6).

The middle stage spool valve 70 includes a first land 190 and a second land 192. In the depicted embodiment, the first land 190 is oppositely disposed from the second land 192.

In the neutral position $P_{MN}$, the first land 190 of the middle stage spool valve 70 blocks fluid communication between the first load holding portion 118 of the first valve bore 98 and the first portion 122*a* of the first fluid passage 120 while the second land 192 blocks fluid communication between the second load holding portion 128 of the second valve bore 100 and the first portion 131*a* of the second fluid passage 130. With fluid communication between the first load holding portion 118 of the first valve bore 98 and the first portion 122*a* of the first fluid passage 120 blocked, the inlet valve 84 is hydraulically locked in a seated position in which the first tapered surface is seated against the first valve seat 110. With the first tapered surface seated against the first valve seat 110, the fluid communication between the inlet passage 90 and the first service passage 94 is blocked.

With fluid communication between the second load holding portion 128 of the second valve bore 100 and the first portion 131*a* of the second fluid passage 130 blocked, the return valve 86 is disposed in a seated position in which the second tapered surface 172 is seated against the second valve seat 112. With the second tapered surface 172 seated against the second valve seat 112, the fluid communication between the first service passage 94 and the return passage 92 is blocked.

Referring now to FIGS. 3 and 5, the middle stage valve assembly 44 is shown in the first position $P_{M1}$ (shown in FIG. 5). In the first position $P_{M1}$, the first land 190 of the middle stage spool valve 70 at least partially uncovers a first opening 194 to the first portion 122*a* of the first fluid passage 120 at the bore 73. With the first opening 194 to the first portion 122*a* of the first fluid passage 120 at least partially uncovered, the first position $P_{M1}$ of the middle stage valve assembly 44 is adapted to provide fluid communication between the first load holding portion 118 of the first valve bore 98 and the first portion 122*a* of the first fluid passage 120 in the first position $P_{M1}$. In this position, the inlet valve 84 can move axially in the first valve bore 98. If the flow through the first metering passage 160 is less than the flow through the first fluid passage 120, the first tapered surface of the first poppet valve 134 moves in a first axial direction away from the first valve seat 110 causing a clearance between the first tapered surface and the first valve seat 110. As this clearance increases, the amount of fluid communicated between the inlet passage 90 and the first service passage 94 increases. If the flow through the first metering passage 160 is equal to the flow through the first fluid passage 120, the axial position of the inlet valve 84 is held at a constant axial position. If the flow through the first metering passage 160 is greater than the flow through the first fluid passage 120, the inlet valve 84 moves in a second axial direction toward the first valve seat 110 causing the clearance between the first tapered surface and the first valve seat 110 to decrease. As this clearance decreases, the amount of fluid communicated between the inlet passage 90 and the first service passage 94 decreases.

The amount of flow through the first metering passage 160 is governed primarily by the size of an opening created between the first metering slot 158 and a first recess 196 in the second axial end 108*a* of the first valve bore 98. As the opening between the first metering slot 158 and the first recess 196 increases, the amount of flow through the first metering passage 160 increases.

Referring now to FIGS. 1, 4 and 6, the middle stage valve assembly 44 is shown in the second position $P_{M2}$ (shown in FIG. 6). In the second position $P_{M2}$, the second land 192 of the middle stage spool valve 70 at least partially uncovers a second opening 198 to the first portion 131*a* of the second fluid passage 130 at the bore 73. With the second opening 198 to the first portion 131*a* of the second fluid passage 130 at least partially uncovered, the second position $P_{M2}$ is adapted to provide fluid communication between the second load holding portion 128 of the second valve bore 100 and the second fluid passage 130.

With the middle stage spool valve 70 in the second position $P_{m2}$, the first land 190 blocks the first opening 194 to the first portion 122*a* of the first fluid passage 120. With the pathway from the first load holding portion 118 of the first valve bore 98 to the first service portion 116 of the first valve bore 98 blocked, the input valve 84 is hydraulically locked in the seated position.

Pressurized fluid from the first port 32 of the fluid actuator 16 flows through the first service passage 94 of the valve housing 88. The pressurized fluid acts on the first end portion 164 of the second poppet valve 162 of the return valve 86. In the depicted embodiment, pressurized fluid acts on a portion of the second tapered surface 172 of the first end portion 164 of the second poppet valve 162. The fluid acting on the portion of the second tapered surface 172 of the second poppet valve 162 forces the second poppet valve 162 away from the second valve seat 112 to an unseated position when the middle stage spool valve 70 is in the second position $P_{M2}$. As the second poppet valve 162 moves in the second valve bore 100 in an axial direction away from the second valve seat 112, fluid in the second load holding portion 128 of the second valve bore 100 is communicated to the first portion 131*a* of the second fluid passage 130 through the bore 73 of the middle stage valve assembly 44. The fluid in the second fluid passage 130 flows through the one-way valve 132 and to return passage 92.

With the second poppet valve 162 in the unseated position, a clearance 200 is defined between the second tapered surface 172 of the second poppet valve 162 and the second valve seat 112. Fluid from the fluid actuator 16 flows from the first service passage 94 through the clearance 200 and to the return passage 92. As this clearance 200 increases, the amount of fluid communicated between the first service passage 94 and the return passage 92 increases. If the flow through the second metering passage 176 is equal to the flow through the second fluid passage 130, the axial position of the return valve 86 is held at a constant axial position. If the flow through the second metering passage 176 is greater than the flow through the second fluid passage 130, the return valve 86 moves in an axial direction toward the second valve seat 112 causing the clearance 200 between the second tapered surface 172 of the second poppet valve 162 and the second valve seat 112 to decrease. As this clearance 200 decreases, the amount of fluid communicated between the first service passage 94 and the return passage 92 decreases.

Figure 7:
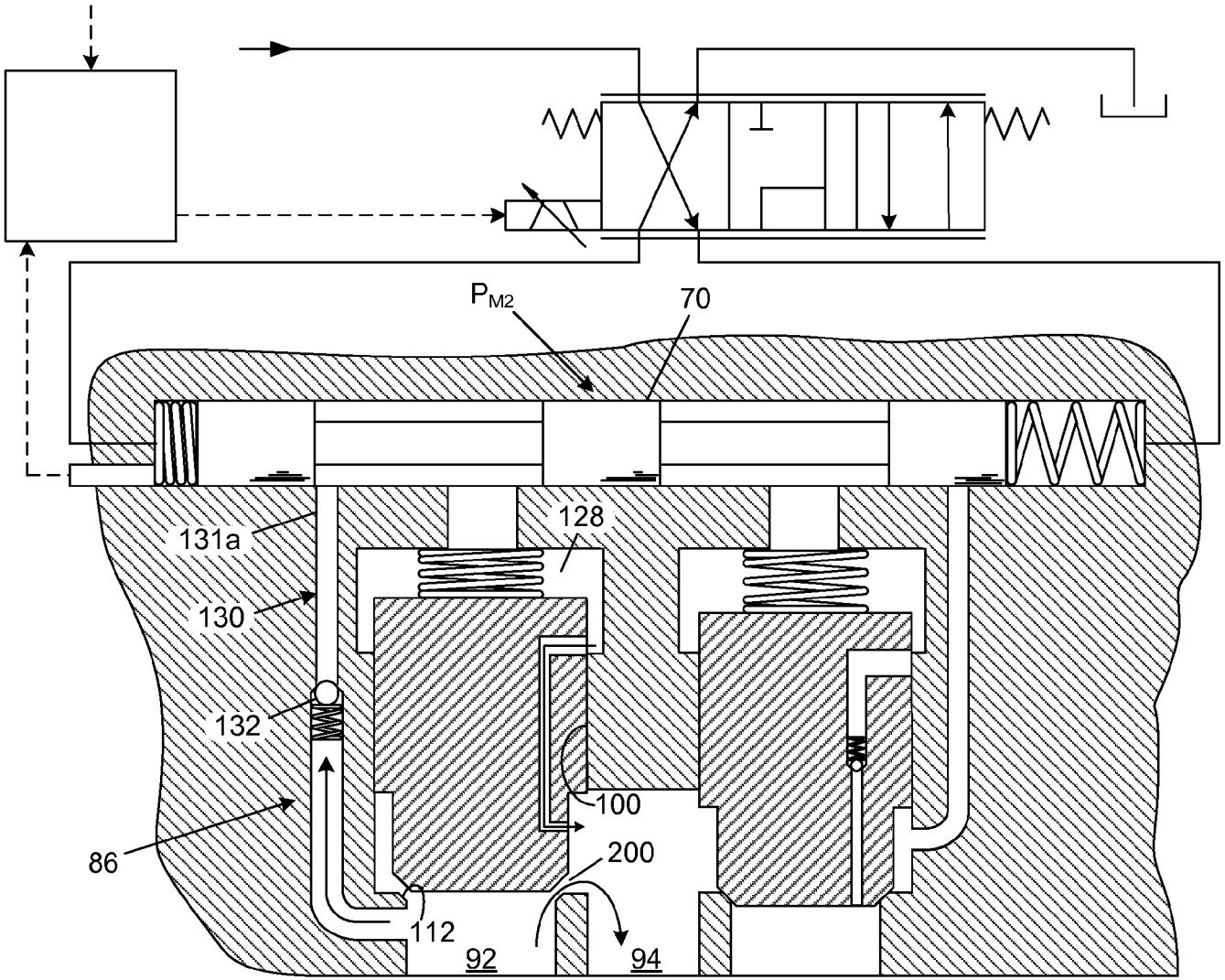
FIG. 7 is a schematic representation of the valve assembly with the middle stage valve assembly in the second position and return valve assembly in the unseated position.

Referring now to FIGS. 1, 4 and 7, the anti-cavitation feature of the return valve 86 will be described. As previously provided, cavitation in the fluid system 10 occurs when the fluid actuator 16 requires more fluid than is being provided by the fluid pump 14. In this situation, the pressure of the fluid in the return passage 92 is greater than the pressure of the fluid in the first service passage 94.

With the middle stage spool valve 70 in the second position $P_{M2}$, fluid from the return passage 92 acts against the first end face 168 of the second poppet valve 162. The fluid acting on the first end face 168 forces the second poppet valve 162 away from the second valve seat 112 to the unseated position. As the pressure of the fluid in the return passage 92 is greater than the pressure of the fluid in the first service passage 94, the fluid in the second load holding portion 128 of the second valve bore 100 is displaced through the second metering passage 176 of the second poppet valve 62 to the first service passage 94 as the second poppet valve 162 is moved in the axial direction away from the second valve seat 112. This displacement of fluid from the second load holding portion 128 of the second valve bore 100 to the first service passage 94 allows the second poppet valve 162 to move to the unseated position. With the second poppet valve 162 in the unseated position, fluid from the return passage 92 is communicated to the first service passage 94 through the clearance 200 formed between the second tapered surface 172 of the second poppet valve 162 and the second valve seat 112.

The one-way valve 132 prevents fluid from the return passage 92 from flowing through the second fluid passage 130 to the second load holding portion 128 of the second valve bore 100 when the pressure of the fluid in the return passage 92 is greater than the pressure of the fluid in the first service passage 94. By blocking fluid communication through the second fluid passage 130, the one-way valve 132 prevent fluid from the return passage 92 from being communicated to the second load holding portion 128 of the second valve bore 100 and hydraulically locking the return valve 86 in the seated position.

Referring now to FIG. 1, while the operation of the first valve assembly 40*a* for providing fluid from the inlet passage 90 to the first service passage 94, from the first service passage 94 to the return passage 92, and from the return passage 92 to the first service passage 94 has been described, it will be understood that the second valve assembly 40*b* operates in a similar manner for providing fluid from the inlet passage 90 to the second service passage 96, from the second service passage 96 to the return passage 92 and from the return passage 92 to the second service passage 96 as the structural components of the second valve assembly 40*b* is substantially similar to the first valve assembly 40*a*.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A valve assembly comprising:

a valve housing defining:

a first service passage;

a first valve bore in fluid communication with the first service passage, the first valve bore having an inlet portion in fluid communication with an inlet passage of the valve housing, a first service portion in fluid communication with the first service passage, and a first load holding portion, the first valve bore having a first valve seat that is disposed between the inlet portion and the service portion;

a first fluid passage in selective fluid communication with the first load holding portion of the first valve bore and the first service passage;

a second valve bore in fluid communication with the first service passage, the second valve bore having a return portion in fluid communication with a return passage of the valve housing, a second service portion in fluid communication with the first service passage, and a second load holding portion, the second valve bore having a second valve seat that is disposed between the return passage and the first service passage;

a second fluid passage in selective communication with the second load holding portion of the second valve bore and the return passage;

an inlet valve disposed in the first valve bore, the inlet valve being moveable between a seated position and an unseated position;

a return valve assembly disposed in the second valve bore, the return valve being moveable between a seated position and an unseated position; and a one-way valve disposed in the second fluid passage, wherein the one-way valve allows fluid to flow only in a direction from the second load holding portion to the return passage.

2. The valve assembly of claim 1, wherein the inlet valve includes a body defining a first metering passage through the body, the first metering passage being in fluid communication with the inlet passage and the first load holding portion of the first valve bore.

3. The valve assembly of claim 2, wherein a check valve is disposed in the first metering passage, the check valve providing fluid flow only in a direction from the inlet passage to the first load holding cavity.

4. The valve assembly of claim 2, wherein the return valve defines a second metering passage providing fluid communication between the second load holding portion and the second service portion of the second valve bore.

5. The valve assembly of claim 4, wherein the inlet valve includes a circumferential surface defining a first metering slot, the first metering slot being in fluid communication with the first metering passage.

6. The valve assembly of claim 5, wherein the return valve includes a circumferential surface defining a second metering slot, the second metering slot being in fluid communication with the second metering passage.

7. The valve assembly of claim 1, wherein the first valve seat is frusto-conical in shape.

8. The valve assembly of claim 1, wherein the one-way valve is a check ball.

9. A valve assembly comprising:

a valve housing defining:

a first service passage;

a first valve bore in fluid communication with the first service passage, the first valve bore having an inlet portion in fluid communication with an inlet passage of the valve housing, a first service portion in fluid communication with the first service passage, and a first load holding portion, the first valve bore having a first valve seat that is disposed between the inlet portion and the service portion;

a first fluid passage in selective fluid communication with the first load holding portion of the first valve bore and the first service passage;

a second valve bore in fluid communication with the first service passage, the second valve bore having a return portion in fluid communication with a return passage of the valve housing, a second service portion in fluid communication with the first service passage, and a second load holding portion, the second valve bore having a second valve seat that is disposed between the return passage and the first service passage;

a second fluid passage in selective communication with the second load holding portion of the second valve bore and the return passage;

an inlet valve disposed in the first valve bore, the inlet valve including a body defining a first metering passage through the body, the first metering passage being in fluid communication with the inlet passage and the first load holding portion of the first valve bore, the inlet valve further including a check valve disposed in the first metering passage, the check valve providing fluid flow only in a direction from the inlet passage to the first load holding cavity;

a return valve assembly disposed in the second valve bore, the return valve defining a second metering passage that provides fluid communication between the second load holding portion and the second service portion of the second valve bore; and a one-way valve disposed in the second fluid passage, wherein the one-way valve allows fluid to flow only in a direction from the second load holding portion to the return passage.

10. The valve assembly of claim 9, wherein the inlet valve includes a circumferential surface defining a first metering slot, the first metering slot being in fluid communication with the first metering passage.

11. The valve assembly of claim 10, wherein the return valve includes a circumferential surface defining a second metering slot, the second metering slot being in fluid communication with the second metering passage.

12. The valve assembly of claim 9, wherein the first valve seat is frusto-conical in shape.

13. The valve assembly of claim 9, wherein the one-way valve is a check ball.

14. The valve assembly of claim 9, further comprising a middle stage valve assembly in fluid communication with the inlet valve and the return valve, the middle stage valve assembly being adapted to provide fluid communication between the first load holding portion of the first valve bore and the first fluid passage and between the second load holding portion of the second valve bore and the second fluid passage.

15. The valve assembly of claim 14, wherein the middle stage valve assembly is a four-way, three-position proportional valve.

16. A valve assembly comprising:

a pilot stage valve assembly;

a middle stage valve assembly in fluid communication with the pilot stage valve assembly;

a main stage valve assembly in fluid communication with the middle stage valve assembly, the main stage valve assembly including:

a valve housing defining:

a first service passage;

a first valve bore in fluid communication with the first service passage, the first valve bore having an inlet portion in fluid communication with an inlet passage of the valve housing, a first service portion in fluid communication with the first service passage, and a first load holding portion, the first valve bore having a first valve seat that is disposed between the inlet portion and the service portion;

a first fluid passage in selective fluid communication with the first load holding portion of the first valve bore and the first service passage;

a second valve bore in fluid communication with the first service passage, the second valve bore having a return portion in fluid communication with a return passage of the valve housing, a second service portion in fluid communication with the first service passage, and a second load holding portion, the second valve bore having a second valve seat that is disposed between the return passage and the first service passage;

a second fluid passage in selective communication with the second load holding portion of the second valve bore and the return passage;

an inlet valve disposed in the first valve bore, the inlet valve including a body defining a first metering passage through the body, the first metering passage being in fluid communication with the inlet passage and the first load holding portion of the first valve bore, the inlet valve further including a check valve disposed in the first metering passage, the check valve providing fluid flow only in a direction from the inlet passage to the first load holding cavity;

a return valve assembly disposed in the second valve bore, the return valve defining a second metering passage that provides fluid communication between the second load holding portion and the second service portion of the second valve bore; and a one-way valve disposed in the second fluid passage, wherein the one-way valve allows fluid to flow only in a direction from the second load holding portion to the return passage.

17. The valve assembly of claim 16, wherein the pilot stage valve assembly includes an electronic actuator.

18. The valve assembly of claim 17, wherein the electronic actuator is a voice coil.

19. The valve assembly of claim 16, wherein pilot stage valve assembly provides fluid to at least one end of a middle stage spool valve of the middle stage valve assembly to actuate the middle stage valve assembly.

20. The valve assembly of claim 16, wherein the middle stage valve assembly is a four-way, three-position proportional valve.

* * * * *